US005388636A

United States Patent [19]

Peery

[11] Patent Number: 5,388,636

[45] Date of Patent: Feb. 14, 1995

[54] SYSTEM FOR CLEANING THE INSIDE OF TUBING

[75] Inventor: Moshe Peery, Kibbutz Yotvata, Israel

[73] Assignee: C.Q.M. Ltd., Rishon le'Zion, Israel

[21] Appl. No.: 154,062

[22] Filed: Nov. 18, 1993

[51] Int. Cl.[6] ..... F28G 1/12

[52] U.S. Cl. ..... 165/95; 15/3.51

[58] Field of Search ..... 165/95; 15/3.5, 3.51

[56] References Cited

U.S. PATENT DOCUMENTS

| | | | |
|---|---|---|---|
| 3,882,931 | 5/1975 | Kumagai | 165/95 |
| 3,919,732 | 11/1975 | Honma et al. | 15/3.51 |
| 3,978,917 | 9/1976 | Honma et al. | 165/95 |
| 4,234,993 | 11/1980 | Kintner | 15/104.06 A |
| 4,554,965 | 11/1985 | Bochinski et al. | 165/95 |
| 4,556,102 | 12/1985 | Bochinski et al. | 165/95 |
| 4,865,121 | 9/1989 | Ben-Dosa | 165/95 |

FOREIGN PATENT DOCUMENTS

| | | | |
|---|---|---|---|
| 525076 | 12/1953 | Belgium | 165/95 |
| 1247359 | 8/1967 | Germany | 165/95 |
| 14190 | 1/1982 | Japan | 165/95 |
| 356697 | 12/1992 | Japan | 165/95 |
| 1492205 | 7/1989 | U.S.S.R. | 165/95 |

*Primary Examiner*—Martin P. Schwadron
*Assistant Examiner*—L. R. Leo
*Attorney, Agent, or Firm*—Mark M. Friedman

[57] ABSTRACT

A system for cleaning the inside of tubing, as of a heat exchanger, which is made up of a number of balls entrained by a liquid flowing through the system, a separator for separating the balls from the liquid downstream of the tubing, an accumulator for accumulating the balls downstream of the separator, a storage tank for storing a volume of injection liquid, and a mechanism for injecting the balls upstream of the tubing by displacement of the injection liquid from the storage to upstream of the tubing through the accumulator to entrain the balls therewith. The accumulator and the storage tank can be combined in a single housing or configured as separate airtight housings.

8 Claims, 10 Drawing Sheets

SYSTEM FOR CLEANING THE INSIDE OF TUBING

FIELD AND BACKGROUND OF THE INVENTION

The present invention relates to systems using balls for cleaning the inside of tubing in condensers and other forms of heat-exchangers in general, and to apparatus for recirculating the balls within such systems in particular.

Systems for cleaning the inside of tubing using balls for preventing the build up of coatings or any other fouling inside the tubing as they travel the length thereof are known in the art.

Various attempts have been made to design and implement efficient apparatus for recirculating the balls from the downstream side of the tubing to the upstream side of the tubing for another pass therethrough. Some systems, for example U.S. Pat. Nos. 3,882,931 to Kumagai and 4,234,993 to Kintner, use continuously driven pumps for recirculating the balls. Such systems are not only expensive but also suffer from considerable downtime for maintenance and repair purposes.

Other systems, for example U.S. Pat. No. 4,865,121 to Ben-Dosa, use a mechanically actuated ejector for ejecting the balls back into the upstream side of the tubing. Such type of ejectors are highly susceptible to malfunctioning because of the tendency of the balls to get wedged between the ejector and a separator screen and therefore also require considerable downtime for maintenance and repair purposes.

There is thus a widely recognized need for, and it would be highly advantageous to have, a system for cleaning the inside of tubing which includes simple, inexpensive and effective apparatus for recirculating the balls therethrough.

SUMMARY OF THE INVENTION

According to the present invention there is provided a system for cleaning the inside of tubing, comprising: (a) a plurality of balls entrained by a liquid flowing through the system; (b) separation means for separating the balls from the liquid downstream of the tubing; (c) accumulator means for accumulating the balls downstream of the separation means; (d) storage means for storing a volume of injection liquid, the storage means being in communication with the accumulator means; and (e) injection means for injecting the balls upstream of tubing by displacing the volume of injection liquid from the storage means to upstream of tubing through the accumulator means for entraining the balls therewith.

According to further features in preferred embodiments of the invention described below, the separating means balls includes a generally cylindrical sieve and a drain conduit centrally deployed with respect thereto.

The accumulator means and storage means can be combined in a single housing which includes a sieve such that the storage means is at least partly filled by liquid run-off from the accumulator means or they can be configured as two separate airtight housings.

The injecting means includes a pressure increasing device for increasing the pressure in the storage means in the form of a compressor while the system also comprises a pressure decreasing device for decreasing the pressure in the storage means in the form of a release valve or a pump.

In another embodiment of the present invention, there is provided a system for cleaning the inside of tubing, comprising: (a) a plurality of balls entrained by a liquid flowing through the system; (b) separation means for separating the balls from the liquid downstream of the tubing; (c) accumulator means for accumulating the balls downstream of the separation means; (d) venturi means upstream of the tubing and in communication with the accumulator means for drawing the balls upstream of the tubing; and (e) valve means for selectively diverting substantially all of the liquid to flow through the venturi means.

In yet another embodiment of the present invention, there is provided a system for cleaning the inside of tubing, comprising: (a) a plurality of balls entrained by a liquid flowing through the system; (b) separation means for separating the balls from the liquid downstream of the tubing; (c) accumulator means for accumulating the balls downstream of the separation means; (d) pump means upstream of the tubing and in communication with the accumulator means for drawing the balls upstream of the pump; and (e) valve means for selectively communicating between the pump means and the accumulator means.

The present invention successfully addresses the shortcomings of the presently known configurations by providing a system for cleaning tubing which includes simple and efficient apparatus for recirculating the balls therethrough.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a system using balls for cleaning the tubing in condensers and other forms of heat-exchangers and more particularly of an apparatus for recirculating the balls therethrough.

Specifically, the present invention can be used to improve the efficiency of existing systems by reducing downtime for maintenance and repair purposes.

The principles and operation of a cleaning system according to the present invention may be better understood with reference to the drawings and the accompanying description.

Figure 1A:
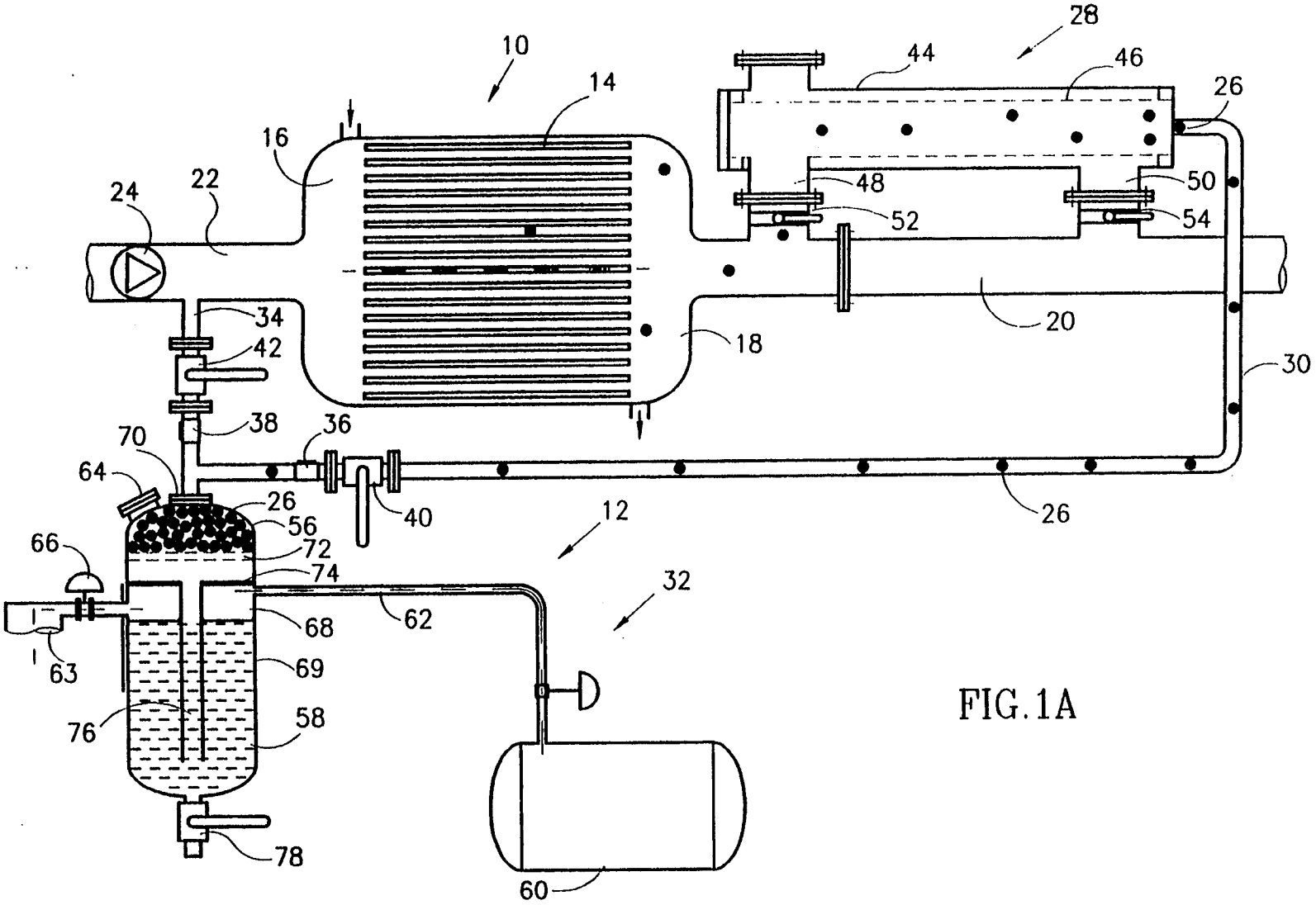
FIGS. 1*a* and 1*b* are schematic views of a preferred embodiment of a system for cleaning tubing including apparatus for recirculating balls therethrough according to the present invention where the system is shown before actuation of the apparatus in FIG. 1*a* and sometime after actuation in FIG. 1*b;*
Figure 1B:
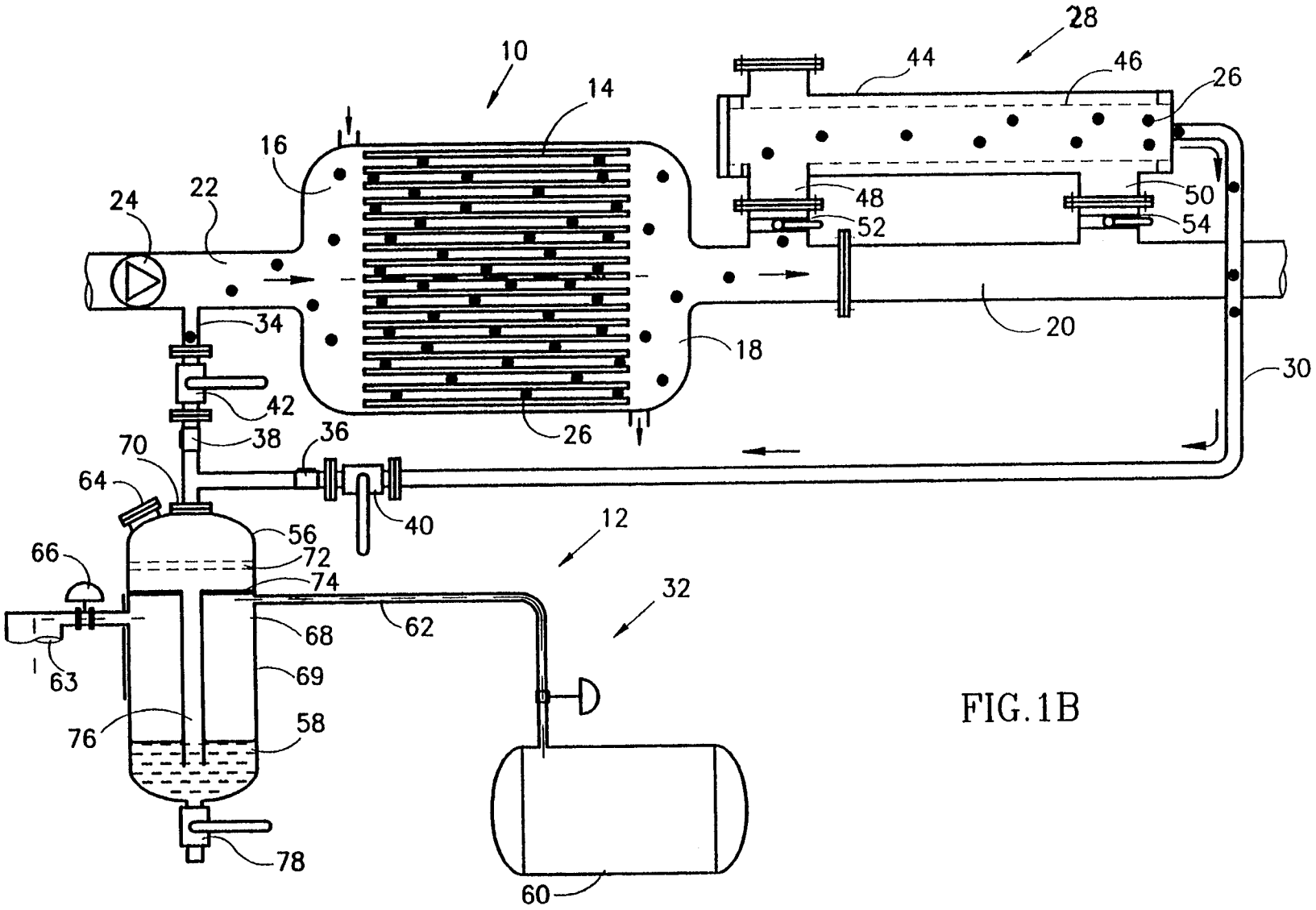

Referring now to the drawings, FIGS. 1*a* and 1*b* are schematic views of a condenser, generally designated 10, equipped with a cleaning system, generally designated 12, according to the present invention. Condenser 10 includes a bank of tubes 14 through which a cooling liquid, such as water, is circulated from an inlet header 16 at the upstream side thereof to an outlet header 18 at the downstream side thereof and thereafter to an outlet conduit 20. Cooling liquid is typically pumped to inlet conduit 22 by a pump 24. Cooling liquid passes through tubing 14 to condense a fluid, such as steam or refrigerant gas, circulated from an inlet duct through spaces between tubing 14 to an outlet duct.

System 12 comprises a plurality of balls 26 for forced circulation through tubing 14 for cleaning same of bacteria or scale as it forms. Balls 26 after a pass through tubing 14 are separated from the downstream flow of liquid in outlet conduit 20 by a separator system, generally designated 28. Balls 26 are then transported via a drain conduit 30 to an apparatus, generally designated 32, for recirculation via a return conduit 34 to inlet conduit 22 upstream of tubing 14.

Separator system 28 preferably comprises a shunt conduit 44, housing a generally cylindrical sieve 46, disposed between inlet and outlet pipes 48 and 50, respectively, in communication with outlet conduit 20. Conduit 30 is preferably centrally deployed with respect to sieve 46 for improved catching of balls 26 as liquid drains thereinto. Inlet and outlet pipes 48 and 50 are preferably provided with normally open valves 52 and 54 which are periodically closed for interrupting operation of separator system 28 for cleaning and other maintenance purposes thereof without having to interrupt the operation of condenser 10.

Conduits 30 and 34 are provided with one-way valves 36 and 38, respectively, where one-way valve 36 is normally open and one-way valve 38 is normally closed during operation of system 12. However, one-way valve 36 is momentarily closed and one-way vane 38 is momentarily opened during an injection of balls 26 upstream of tubing 14 as will be described below. In addition, conduits 30 and 34 can be provided with normally open valves 40 and 42, respectively, which are periodically closed for maintenance and repair purposes of system 12 without having to interrupt the operation of condenser 10.

Balls 26 are accumulated after a pass through tubing 14 in accumulator means in the form of a trap 56 in readiness for being injected into inlet conduit 22 at a position upstream of tubing 14 by displacement of a volume of injection liquid therethrough. Trap 56 preferably has sufficient storage capacity to accommodate all balls 26 in circulation. The volume of injection fluid is stored in a storage means in the form of a tank 58 which is in communication with trap 56. Tank 58 can be filled either by run-off from trap 56 or from a separate source of liquid and preferably has sufficient storage capacity for injecting all the balls stored in trap 56 into the mainstream liquid flow. By comparing FIGS. 1*a* and 1*b*, it can be readily seen that trap 56 and tank 58 are typically full before displacement of injection liquid and empty thereafter.

Figure 1C:
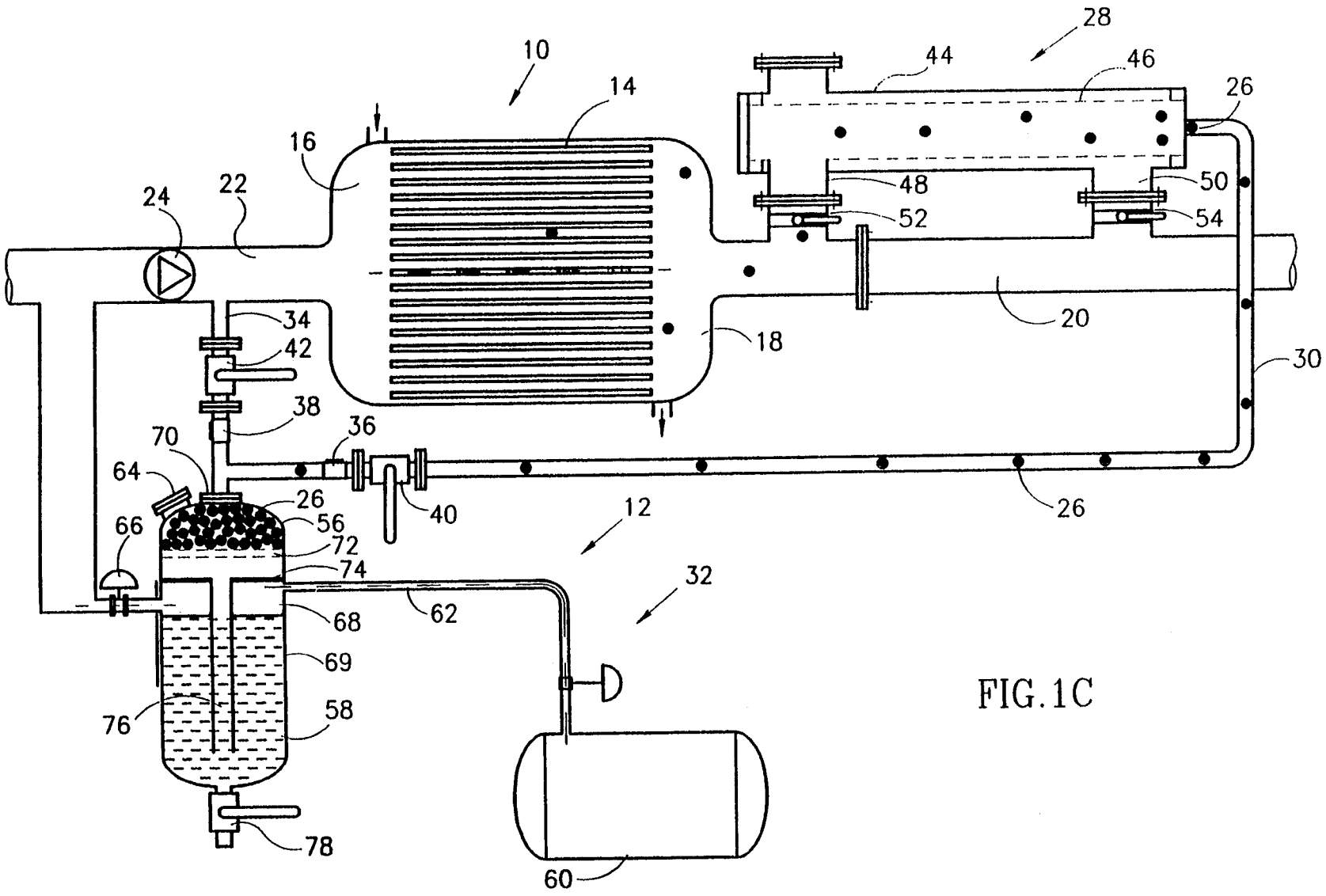
FIGS. 1*c* and 1*d* are schematic views of the system for cleaning tubing of FIG. 1*a* and 1*b* including other embodiments of the apparatus for recirculating balls therethrough according to the present invention where the system is shown before actuation of the apparatus.
Figure 1D:
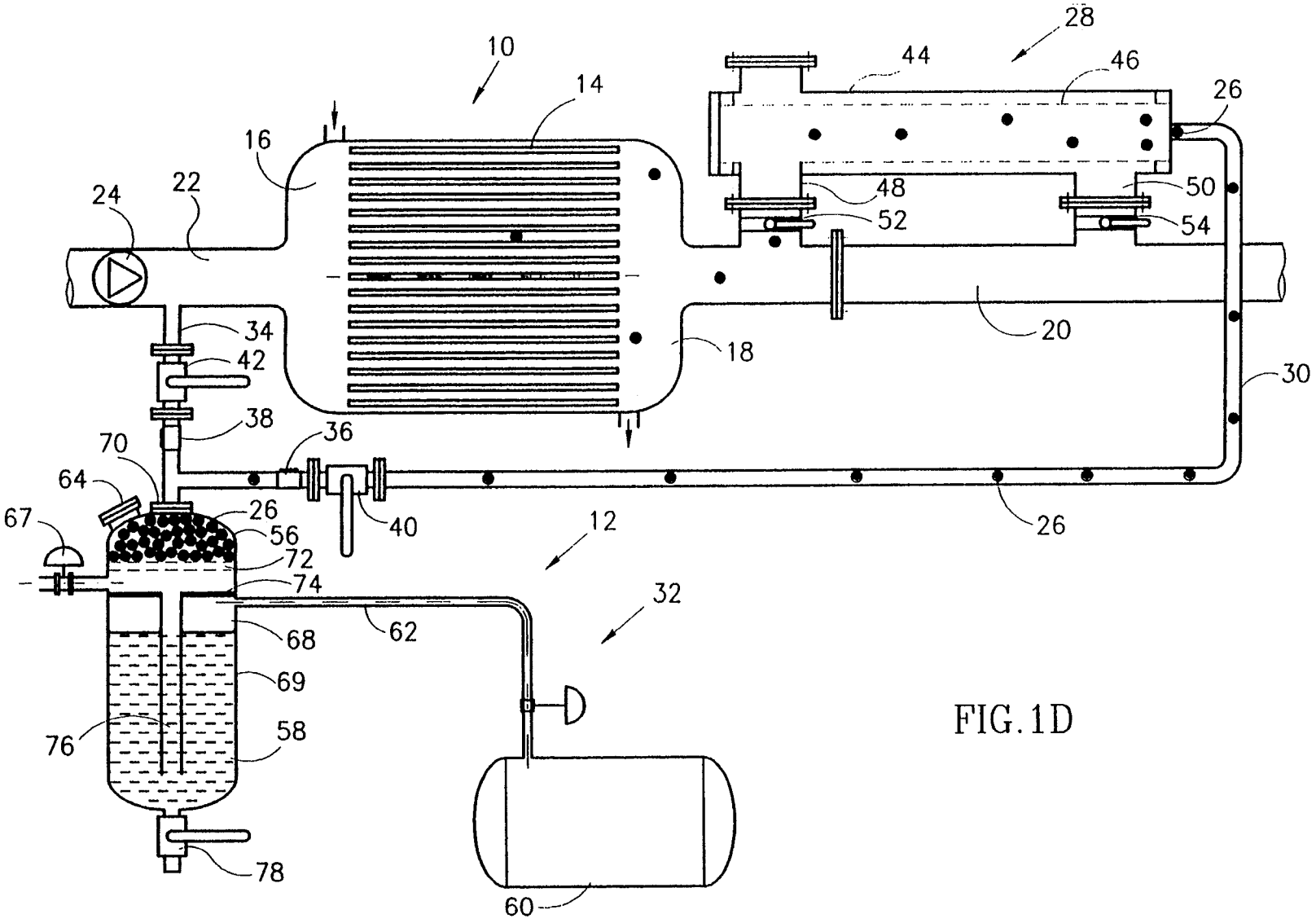

The displacement of the volume of injection liquid is achieved by a pressure increasing device 60, in the form of a compressor or other means, for increasing the prevailing pressure in tank 58 via an air line 62. System 12 is primed for a subsequent recirculation of balls 26 by lowering the pressure in tank 58 by any one or combination of three pressure releasing devices which can include a release valve 66 leading to a drain 63 at atmospheric pressure as shown in FIGS. 1*a* and 1*b*, a conduit 65 provided with valve 66 in communication with inlet conduit 22 upstream of pump 24 as shown in FIG. 1*c* or a valve 67 deployed in trap 56 as shown in FIG. 1*d*. Compressor 60 and the pressure releasing devices are operated according to a pre-determined schedule or manually activated whenever it is desired to clean the tubes.

In the preferred embodiment of the present invention, trap 56 and tank 58 are preferably combined in a single housing 68 having walls 69 and a port 70 through which pass both incoming and outgoing balls 26. A sieve 72 separates balls 26 from the cooling liquid draining through port 70 from conduit 30 and stores them in readiness for recirculation. The liquid which runs-off from sieve 72 is captured by a catch basin 74 having a downwardly depending tube 76 and is stored in tank 58 in readiness for injecting balls 26 back into recirculation. Housing 58 can be further provided with a viewing glass 64 for enabling observation of the accumulation and discharge of balls 26 and a drainage valve 78 for cleaning and other maintenance purposes.

An operation cycle of system 12 will now be explained with reference to FIGS. 1*a* and 1*b* where FIG. 1*a* shows balls 26 primarily accumulated in trap 56 just before their injection upstream of tubing 14 while FIG. 1*b* shows balls 26 dispersed through system 12.

Balls 26 accumulate above sieve 72 in trap 56 after being forcibly circulated through system 12 in a generally clockwise direction as shown by the arrows. Cooling liquid after draining through sieve 72 is captured in tank 58. If necessary, tank 58 is topped up with liquid from a separate source to ensure that sufficient volume of injection liquid is stored for injecting all the balls stored in trap 56 into inlet conduit 22.

Injection of balls 26 in trap 56 is achieved by displacement of injection liquid by activation of compressor 60 for pumping compressed air through air supply pipe 62 into tank 58. The compressed air in tank 58 is confined within a sealed chamber defined by walls 69, plate 74, tube 76 and the volume of injection liquid such that the injection liquid is forced upwards through tube 76. As more air is pumped into tank 58, the injection liquid entrains balls 26 accumulated in trap 56, transports them upwards through port 70 and continues to flow through conduit 34 to inject them into inlet conduit 22 upstream of tubing 14 due to its prevailing pressure as it exits port 70 being greater than both the downstream and upstream pressures of tubing 14 causing one way-valve 36 to close and one-way valve 38 to open.

After balls 26 are injected upstream of tubing 14, pressure in tank 58 is reduced such that valves 36 and 38 reopen and reclose, respectively, thereby enabling balls 26 to pass through tubing 14 and separator system 28 before being accumulated in trap 56 once again for a subsequent recirculation through system 12.

Figure 2A:
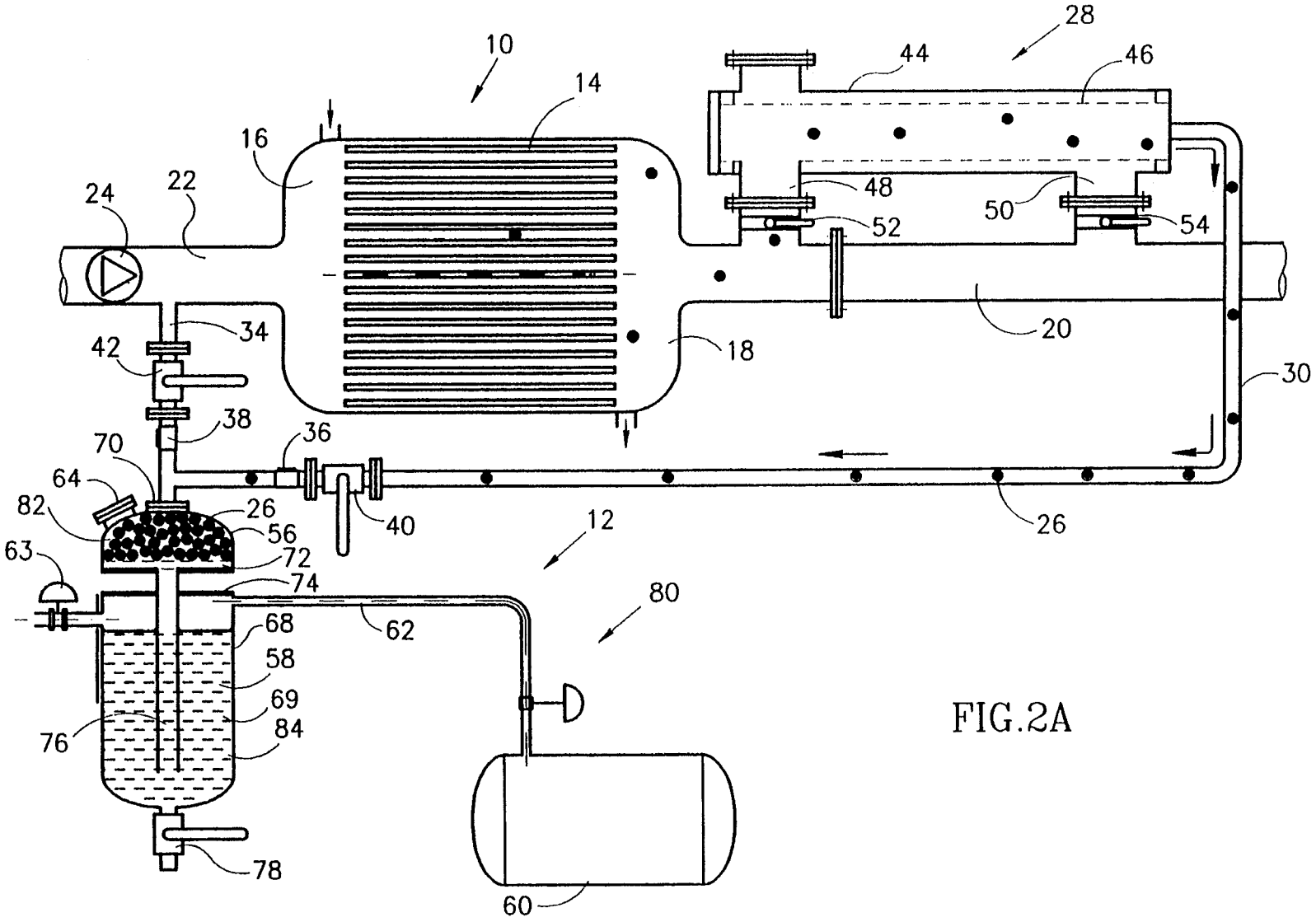
FIGS. 2*a*, 2*b*, 3*a*, 3*b*, 4*a* and 4*b* are schematic views of three further embodiments of apparatus for recirculating balls according to the present invention where the system is shown before actuation of the apparatus in FIGS. 2*a*, 3*a* and 4*a* and sometime after actuation in FIGS. 2*b*, 3*b* and 4*b*.
Figure 2B:
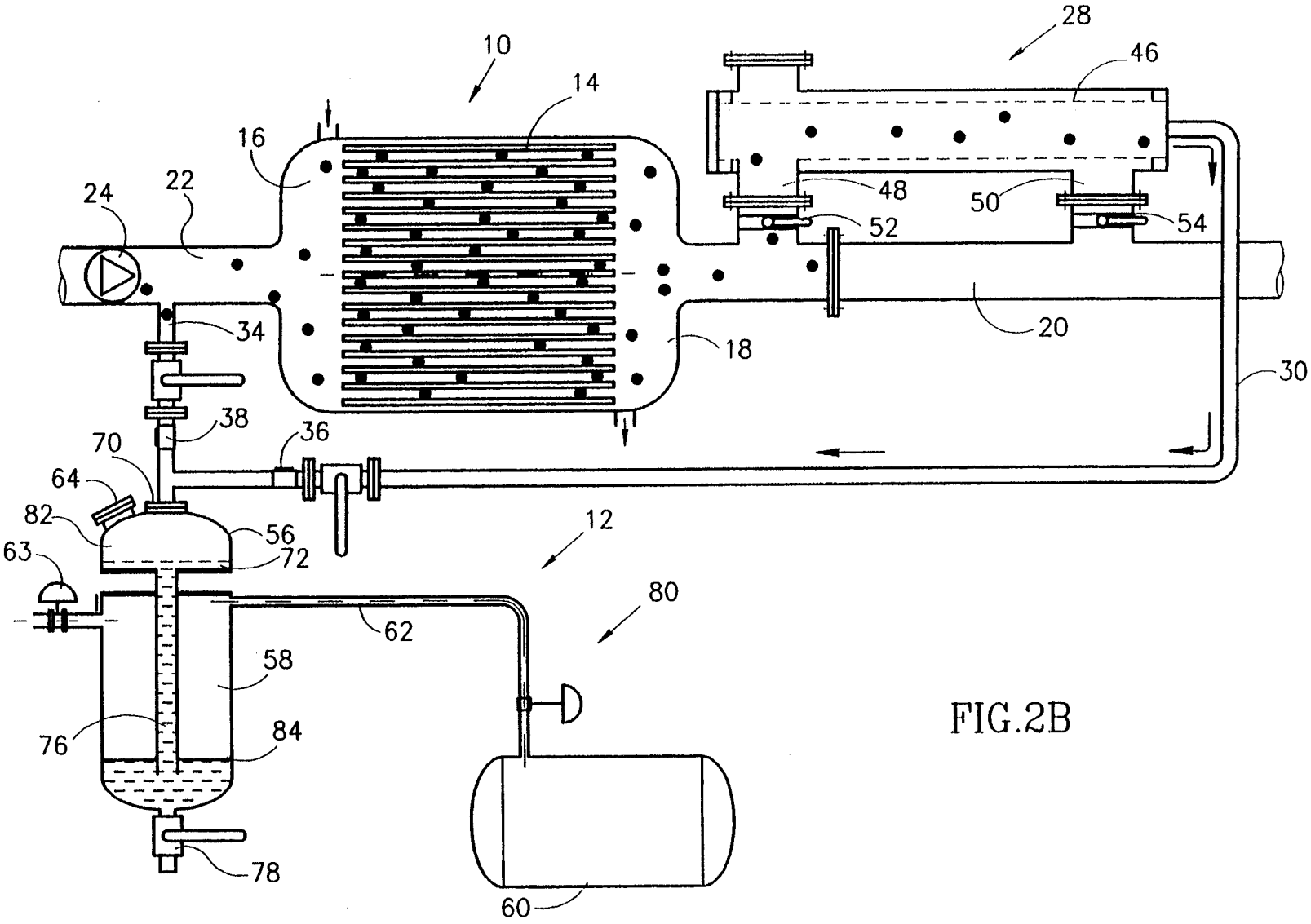

FIGS. 2*a* and 2*b* illustrate a second embodiment of a system, generally designated 80, for cleaning tubing where trap 56 and tank 58 are configured as two separate air tight housings 82 and 84, respectively, connected therebetween by tube 76. Other details of construction and operation of system 80 are similar to those of system 12 and are therefore not explained.

Figure 3A:
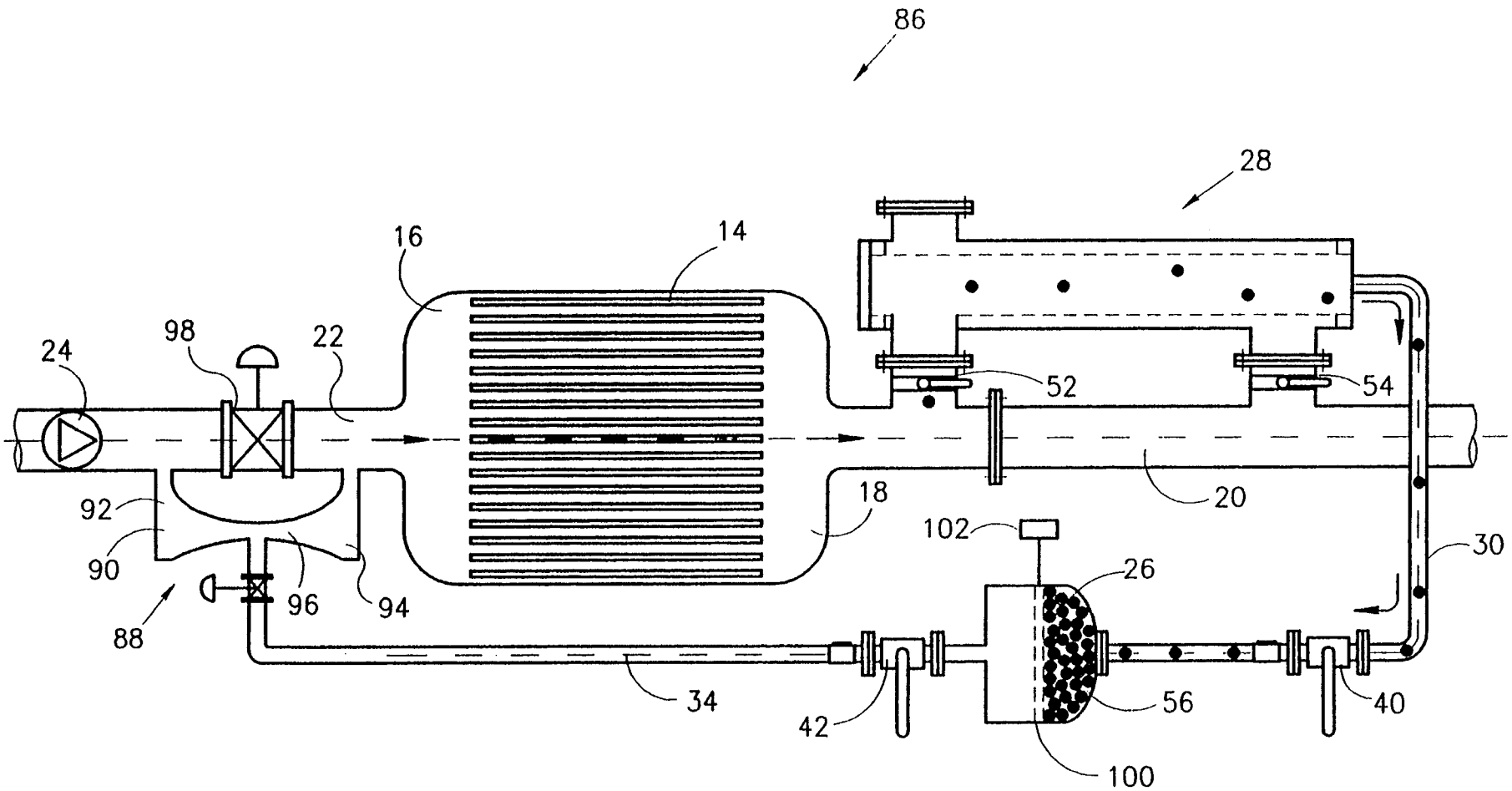
Figure 3B:
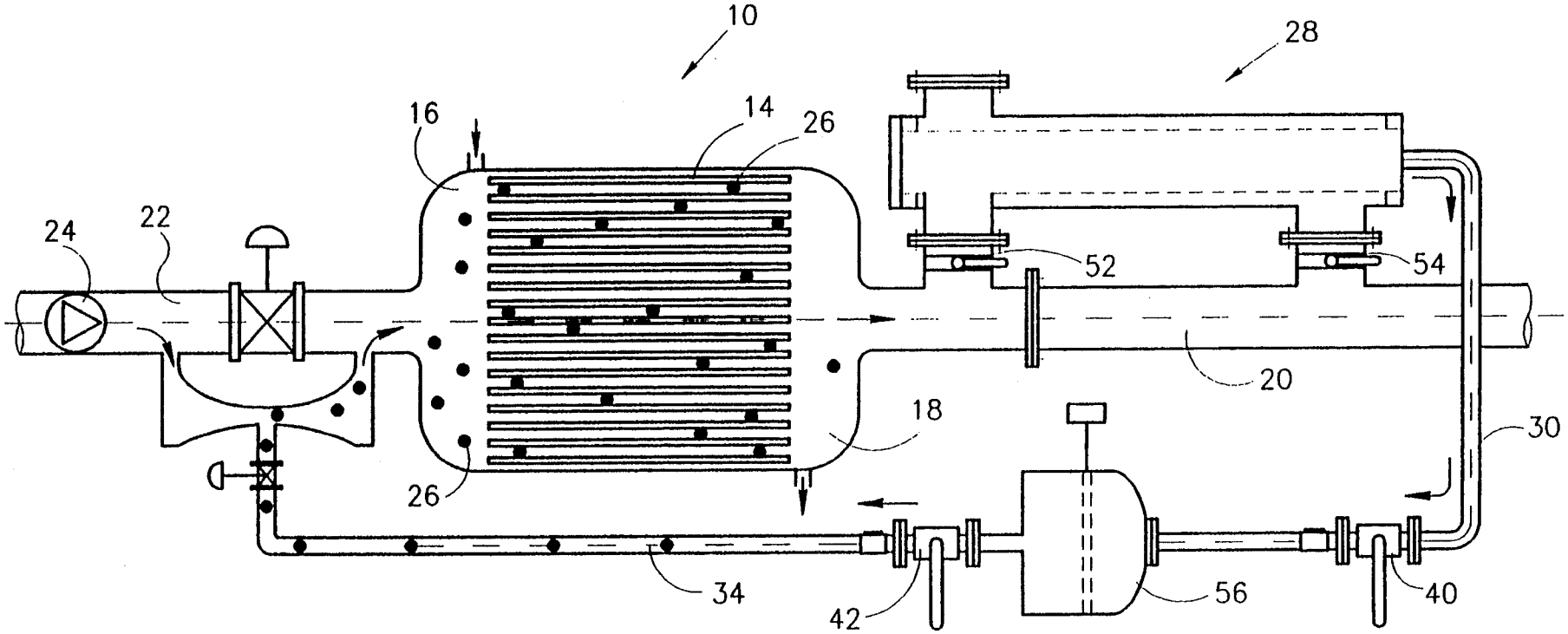

FIGS. 3*a* and 3*b* illustrates a third embodiment of a system, generally designated 86, equipped with venmri apparatus, generally designated 88, in communication with trap 56 via return conduit 34 for drawing balls 26 into inlet conduit 22 upstream of tubing 14.

Apparatus 88 comprises a shunt conduit 90 disposed between inlet and outlet pipes 92 and 94, respectively and having a narrow section 96 such that closing of a normally open valve 98 on inlet conduit 22 causes diversion of liquid through shunt conduit 90 such that the high velocity of the liquid through narrow section 96 draws balls 26 upstream of tubing 14 from trap 56.

Trap 56 preferably has rotatable sieve 100 under the control of an actuator 102 for assuming a first operative position for catching and accumulating balls 26 and a second operative position for releasing balls 26 when valve 98 is closed.

It should be noted that even when valve 98 is open, liquid still flows through venturi apparatus 88, however, there is no appreciable drop in pressure at inlet header 16 because of the relative large diameter of inlet conduit 22 compared to that of section 96.

Figure 4A:
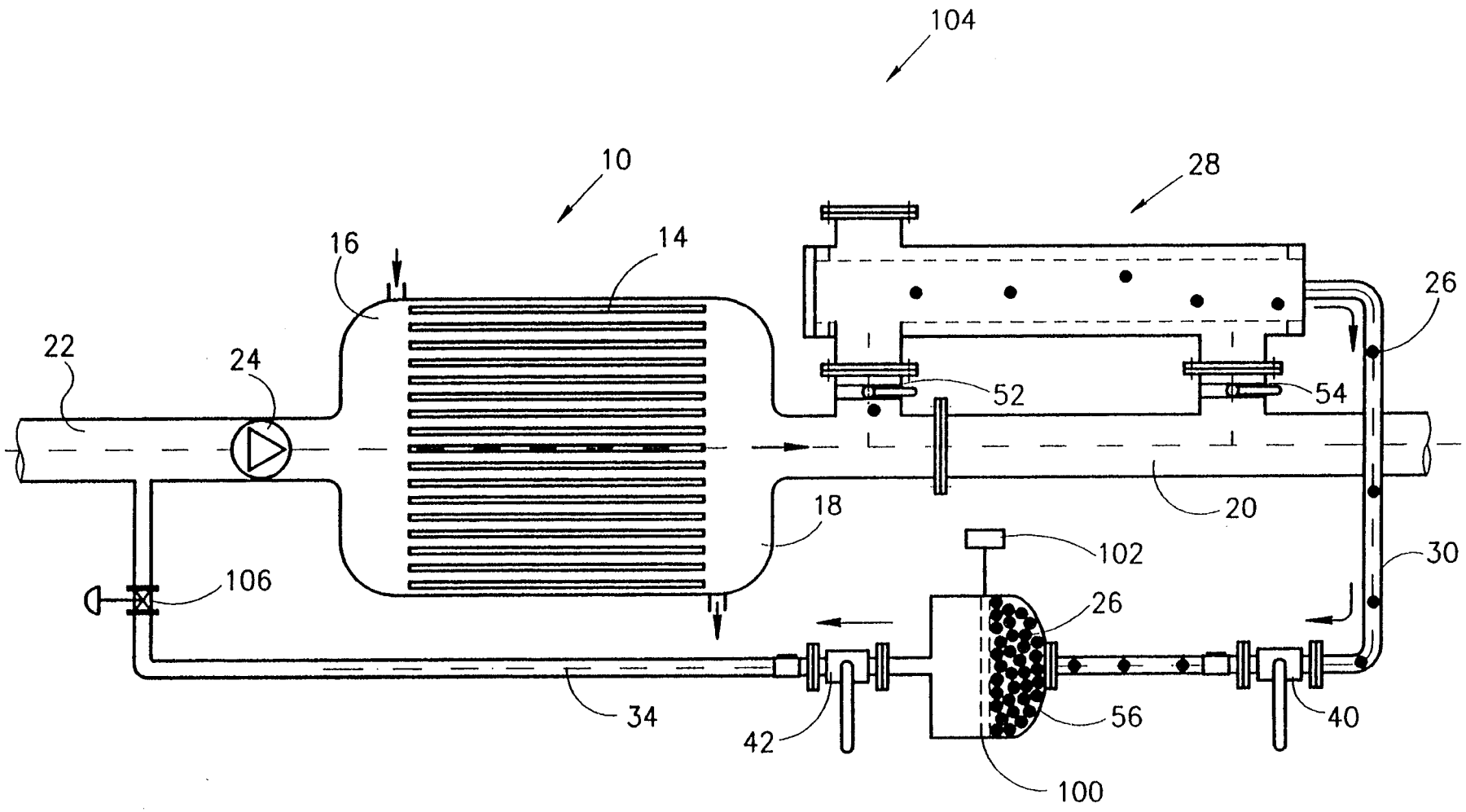
Figure 4B:
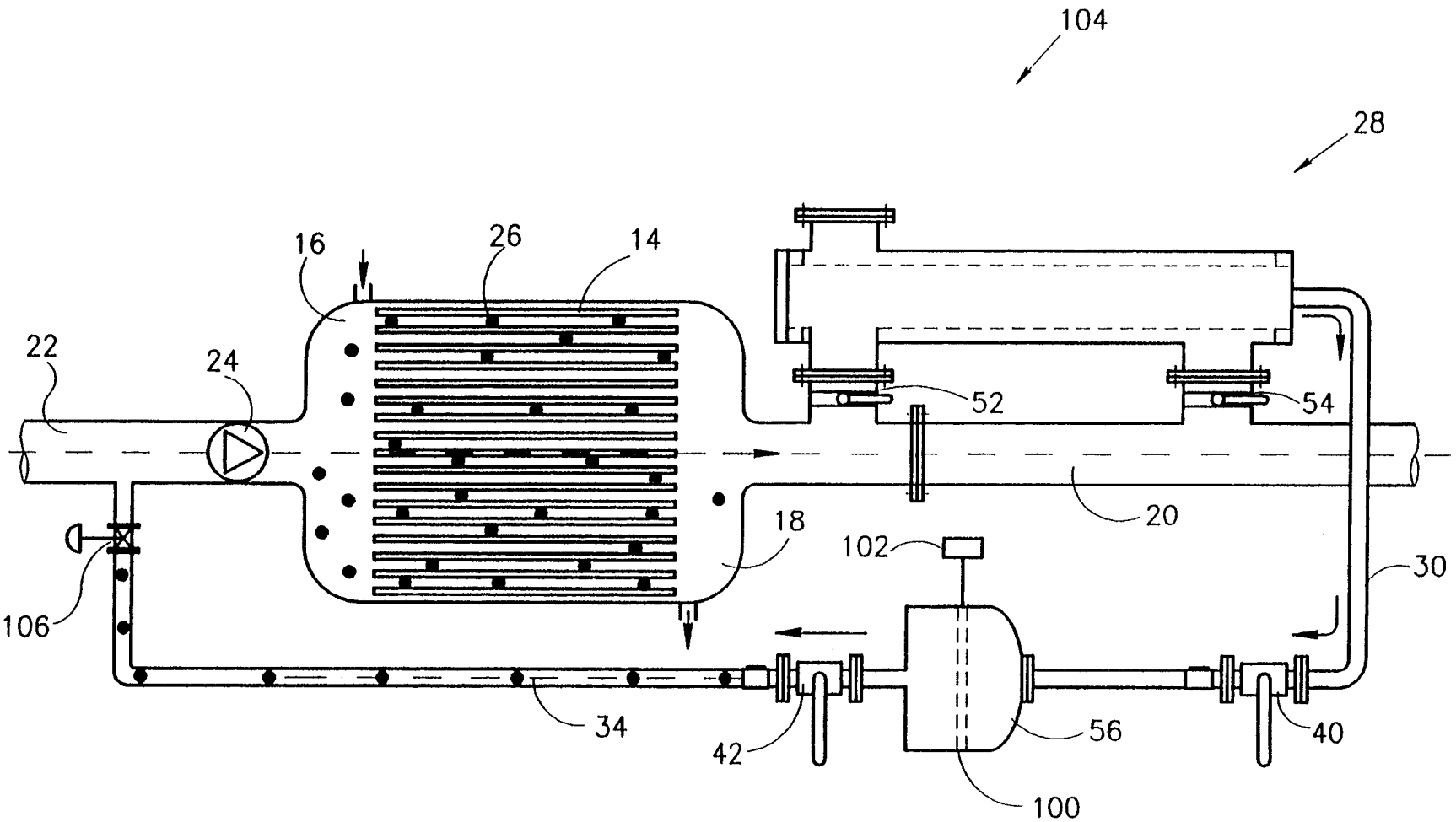

FIGS. 4*a* and 4*b* illustrates a fourth embodiment of a system, generally designated 104 where trap 56 is in communication with inlet conduit 22 upstream of pump 24 for drawing balls 26 thereinto when a valve 106 deployed on return conduit 34 is opened.

Trap 56 preferably has rotatable sieve 100 under the control of an actuator 102 for assuming a first operative position for catching and accumulating balls 26 and a second operative position for releasing balls 26 when valve 106 is opened.

While the invention has been described with respect to a limited number of embodiments, it will be appreciated that many variations, modifications and other applications of the invention may be made.

What is claimed is:

1. A system for cleaning the inside of tubing, comprising:

(a) a plurality of balls entrained by a liquid flowing through the system;

(b) separation means for separating said balls from the liquid downstream of the tubing;

(c) accumulator means for accumulating said balls downstream of said separation means;

(d) storage means for storing a volume of injection liquid, said storage means being in communication with said accumulator means, said storage means being in communication with a point upstream of the tubing; and (e) a compressor for selectively providing a quantity of compressed air into said storage means for injecting at least a portion of said volume of injection liquid from said storage means to said point, said at least a portion of said volume of injection liquid passing through said accumulator means for entraining at least a portion of said balls therewith for injection upstream of the tubing.

2. A system as in claim 1, wherein said separating means balls includes:

a generally cylindrical sieve; and a drain conduit centrally deployed with respect to said sieve.

3. A system as in claim 1, wherein said accumulator means and said storage means are combined in a single housing.

4. A system as in claim 3 wherein said accumulator means includes a sieve and said storage means is at least partly filled by liquid run-off from said accumulator means.

5. A system as in claim 1, wherein said accumulator means and said storage means are configured as two separate airtight housings.

6. A system as in claim 1, further comprising a pressure decreasing means for decreasing the pressure in said storage means.

7. A system as in claim 6, wherein said pressure decreasing device is a release valve.

8. A system as in claim 6, wherein said pressure decreasing means is a pump.

* * * * *